US011303055B2

(12) United States Patent
Schaefer et al.

(10) Patent No.: US 11,303,055 B2
(45) Date of Patent: Apr. 12, 2022

(54) SOCKET CONTACT HAVING SPRING DEVICE

(71) Applicant: TE Connectivity Germany GmbH, Bensheim (DE)

(72) Inventors: Maik Schaefer, Dinkelsbuehl (DE); Soenke Sachs, Frankfurt (DE); Helge Schmidt, Speyer (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/872,709

(22) Filed: May 12, 2020

(65) Prior Publication Data

US 2020/0274276 A1 Aug. 27, 2020

Related U.S. Application Data

(63) Continuation of application No. PCT/EP2018/080595, filed on Nov. 8, 2018.

(30) Foreign Application Priority Data

Nov. 13, 2017 (DE) ..... 102017220185.1

(51) Int. Cl.
*H01R 13/02* (2006.01)
*H01R 13/11* (2006.01)
(Continued)

(52) U.S. Cl.
CPC ..... *H01R 13/113* (2013.01); *H01R 13/03* (2013.01); *H01R 13/14* (2013.01); *H01R 13/18* (2013.01)

(58) Field of Classification Search
CPC ..... H01R 13/113; H01R 13/11; H01R 13/10; H01R 13/02; H01R 13/03; H01R 13/14; H01R 13/15; H01R 13/18
(Continued)

(56) References Cited

U.S. PATENT DOCUMENTS 4,934,965 A * 6/1990 Buddrus ..... H01R 13/113 439/845
5,868,590 A * 2/1999 Dobbelaere ..... H01R 13/18 439/839
(Continued)

FOREIGN PATENT DOCUMENTS

CN 1174424 A 2/1998
CN 1199256 A 11/1998
(Continued)

OTHER PUBLICATIONS

PCT Notification, The International Search Report and The Written Opinion of the International Searching Authority, International Application No. PCT/EP2018/080595, dated Jan. 17, 2019, 13 pages.
(Continued)

*Primary Examiner* — Harshad G Patel
(74) *Attorney, Agent, or Firm* — Barley Snyder

(57) ABSTRACT

A socket contact includes a receptacle receiving a plug contact, a base body surrounding the receptacle at least in sections, a contact element disposed in the receptacle and contacting the plug contact, and a spring device creating a contact normal force at the contact element. The spring device is formed as a part of the base body that surrounds the contact element. The spring device is arranged at a first part and the contact element is arranged at a second part separate from the first part.

19 Claims, 5 Drawing Sheets

(51) Int. Cl.
*H01R 13/03* (2006.01)
*H01R 13/14* (2006.01)
*H01R 13/18* (2006.01)

(58) Field of Classification Search
USPC ..... 439/816, 850–852
See application file for complete search history.

(56) References Cited

U.S. PATENT DOCUMENTS

| | | | | |
|---|---|---|---|---|
| 5,975,964 | A | 11/1999 | Seko et al. | |
| 7,150,660 | B2 * | 12/2006 | Allgood | H01R 11/289 439/845 |
| 8,668,531 | B2 * | 3/2014 | Yamaguchi | H01R 13/187 439/845 |
| 8,678,867 | B2 * | 3/2014 | Glick | H01R 13/187 439/843 |
| 8,827,754 | B2 * | 9/2014 | Lee | H01R 13/187 439/845 |
| 8,827,755 | B2 * | 9/2014 | Blakborn | H01R 13/187 439/845 |
| 9,293,852 | B2 * | 3/2016 | Glick | H01R 13/11 |
| 9,515,403 | B2 * | 12/2016 | Hirakawa | H01R 13/187 |
| 9,985,376 | B2 * | 5/2018 | Zhang | H01R 13/113 |
| 10,511,130 | B2 * | 12/2019 | Huang | H01R 13/11 |
| 2006/0089054 | A1 | 4/2006 | Woo | |
| 2015/0074996 | A1 | 3/2015 | Glick et al. | |
| 2016/0254610 | A1 * | 9/2016 | Hirakawa | H01R 4/18 439/816 |

FOREIGN PATENT DOCUMENTS

| | | | |
|---|---|---|---|
| CN | 102959808 | A | 3/2013 |
| CN | 104253338 | A | 12/2014 |
| CN | 106486791 | A | 3/2017 |
| DE | 4233951 | A1 | 4/1994 |
| DE | 102016104868 | B3 | 5/2017 |
| GB | 342110 | A | 1/1931 |
| JP | 2008176956 | A | 7/2008 |

OTHER PUBLICATIONS

The First Office Action from CNIPA in Appln. No 201880073180.2, dated Nov. 19, 2020 and English translation thereof, 17 pp.
Abstract of CN 1199256A, published Nov. 18, 1998, 1p.
Abstract of CN102959808, published Mar. 6, 2013, 2 pp.
Abstract of CN106486791, published Mar. 8, 2017, 1 p.
Abstract of DE4233951, published Apr. 14, 1994, 1 p.
Abstract of CN104253338, published Dec. 31, 2014, 1 p.
Second Office Action (and English translation thereof) from the CNIPA, dated Jun. 10, 2021 in Application No. 201880073180.2, 18 pp.

* cited by examiner

SOCKET CONTACT HAVING SPRING DEVICE

CROSS-REFERENCE TO RELATED APPLICATIONS

This application is a continuation of PCT International Application No. PCT/EP2018/080595, filed on Nov. 8, 2018, which claims priority under 35 U.S.C. § 119 to German Patent Application No. 102017220185.1, filed on Nov. 13, 2017.

FIELD OF THE INVENTION

The present invention relates to a contact and, more particularly, to a socket contact for receiving a plug contact.

BACKGROUND

A socket contact can, for example, have a spring arm contacting a plug contact inserted into the socket contact. Manufacture of the socket contact with the spring arm, however, is complicated.

SUMMARY

A socket contact includes a receptacle receiving a plug contact, a base body surrounding the receptacle at least in sections, a contact element disposed in the receptacle and contacting the plug contact, and a spring device creating a contact normal force at the contact element. The spring device is formed as a part of the base body that surrounds the contact element. The spring device is arranged at a first part and the contact element is arranged at a second part separate from the first part.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
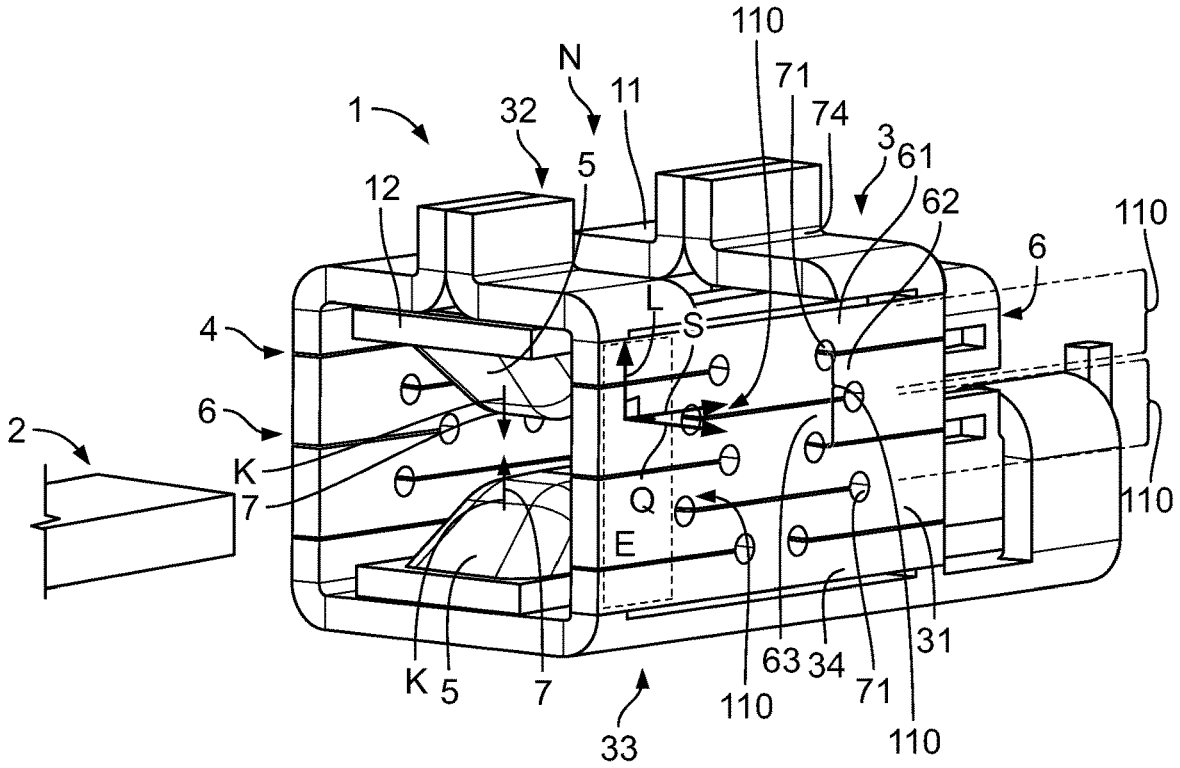
FIG. 1 is a perspective view of a socket contact according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. The embodiments are each independent of one another and can be freely combined with one another, depending on necessity in the specific application.

A socket contact 1 according to an embodiment is shown in FIG. 1. The socket contact 1 has a receptacle 4, into which a plug contact 2, which is shown only schematically, can be plugged along a plug-in direction S.

As shown in FIG. 1, a plurality of contact elements 5 disposed in the receptacle 4 provide contacting, these contact elements 5 exerting a contact normal force 7 directed into the receptacle 4 onto the inserted plug contact 2 along a direction K, which runs perpendicular to the plug-in direction S. To produce the contact normal force 7, the socket contact 1 has a plurality of spring devices 6, which are formed by parts of a base body 3 of the socket contact 1. The base body 3 here surrounds the contact elements 5.

As shown in FIG. 1, the spring devices 6 are part of a side wall 31 of the base body 3, wherein the side walls 31 are each attached to outer sides 34 of the base body 3. The spring devices 6 connect an upper side 32 of the base body 3 to an underside 33 of the base body 3. The contact normal force 7 runs in each case perpendicular to the upper side 32 and to the underside 33 and parallel to the side wall 31. In an embodiment, the upper side 32 and the underside 33 are rigid for stability.

The base body 3 is arranged at a first part 11 of the socket contact 1, as shown in FIG. 1. The contact elements 5 are arranged at a second part 12 of the socket contact 1. The first part 11 and the second part 12 are two separate elements, which have been joined together in a manufacturing process. In an embodiment, the contact elements 5 of the second part 12 are rigidly connected to the first part 11 of the base body 3. Because there are two separate elements, different materials can be used respectively for the contact elements 5 and the base body 3, and the properties of the materials can be adapted to the application.

The material for the contact elements 5 can be copper or a copper-containing substance which has good electrical conducting properties, but which is comparatively easy to deform mechanically. Low transition resistance and/or low internal resistance materials are desirable, for example, such that the contact element 5 can take over the electrical functions of the socket contact 1.

The base body 3 can consist of a mechanically stable material, for example a spring steel, and can take on the mechanical functions of the socket contact 1; high hardness or high tensile strength are desirable, for example. The base body 3 does not necessarily have to have good electrical conductivity, since a flow of current takes place by way of the second part 12 with the contact elements 5.

Manufacture of the socket contact 1 in two separate parts 11, 12 is easier. Furthermore, production of contact 5 is disconnected from creation of the spring force and the two parts 11, 12 can be optimized independently of each other.

In an embodiment, all parts of the socket contact 1 are made from a metal sheet 74 shown in FIG. 1, such that manufacture can take place by way of die-cutting and embossing.

The spring device 6, as shown in FIG. 1, has a plurality of spring sections 110, which are connected in parallel and in series. The spring sections 110 lie side-by-side and behind one another with respect to the direction K of the contact normal force 7. A desired contact normal force 7 can be produced as a result.

The spring device 6 comprises a plurality of limbs 61, 62, 63, whereby in each case a pair of limbs 61, 62, 63 lie next to each other in a neutral state N shown in FIG. 1 and, in a deflected state, are deflected elastically in relation to each other. In another embodiment, at least partial plastic deformation can take place. The limbs 61, 62, 63 are connected to each other in pairs and lie along a longitudinal direction L, which runs parallel to the direction K of the contact normal force 7, behind one another and overlap in this direction. The spring device 6 is thereby lengthenable in the longitudinal direction L, in order to be compatible with various plug contacts 2 of various thickness. The limbs 61, 62, 63 can merge, for example, at a bend or a curve.

In the deflected state, in each case two limbs 61, 62, 63 are separated by a gap 70, for example, as shown in FIGS. 5-8. At the end of the gap 70 is located in each case a hole 71 which is configured as a circle and prevents the possibility of the material beginning to tear when the limbs 61, 62, 63 are deflected in relation to each other. The limbs 61, 62, 63 are in each case planar in design, and lie within a common plane E, such that a compact configuration is possible in a transverse direction Q which is perpendicular to the plug-in direction S and perpendicular to the direction K of the contact normal force and the longitudinal direction L, respectively. The contact elements 5 have adjustable spacing relative to each other and are interconnected by the spring device 6.

Figure 2:
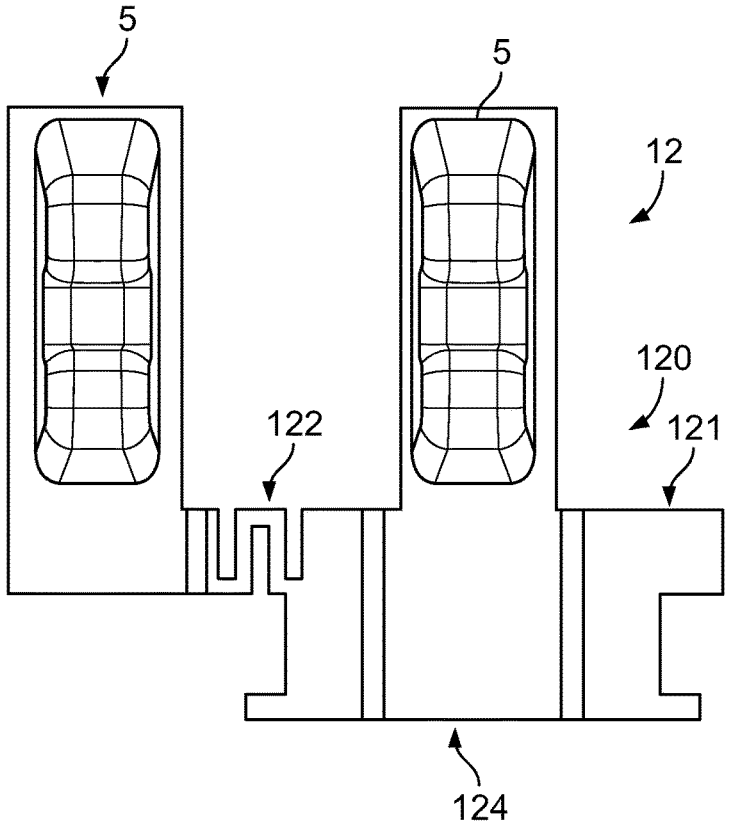
FIG. 2 is a plan view of a part of the socket contact of FIG. 1.

In FIG. 2, the second part 12 in an unfolded state. The second part 12 or a separate part 120, which forms the second part 12, has two contact elements 5 which are connected to each other by a connecting spring 122 and are attached to a base 124, which also serves as a retaining section 121 for retention within the base body 3.

Figure 3:
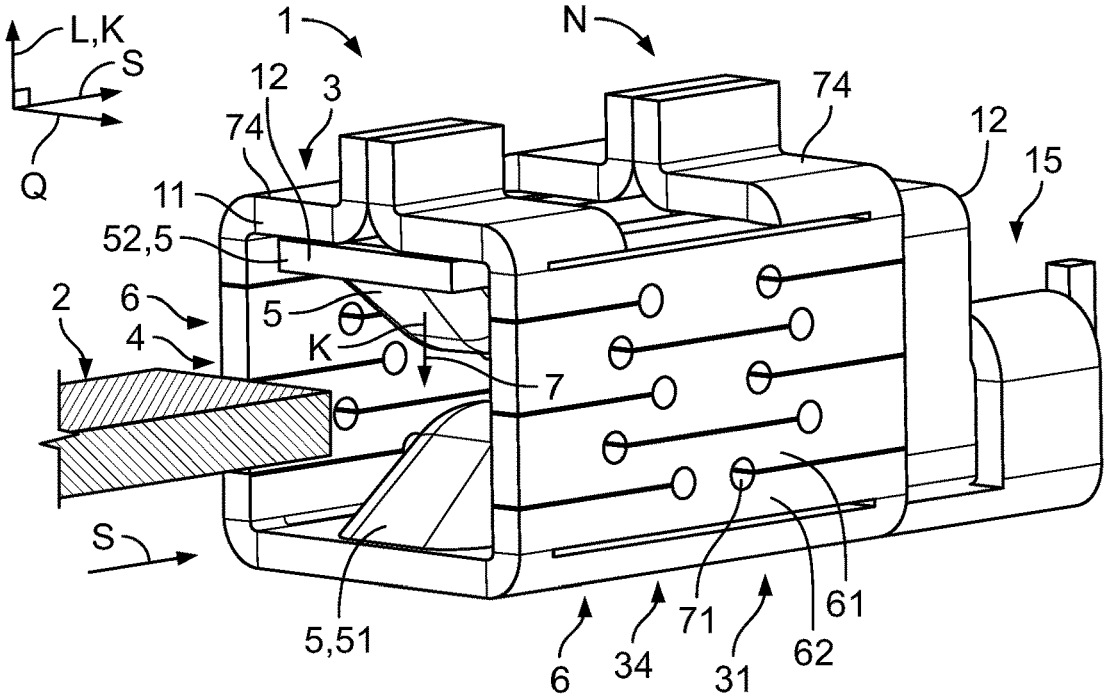
FIG. 3 is a perspective view of a socket contact according to another embodiment.

A socket contact 1 according to another embodiment is shown in FIG. 3. As before, a plug contact 2, which is shown only schematically, can be introduced into a receptacle 4 of the socket contact 1, in order to produce an electrical contact. The second embodiment differs from the first embodiment by the fact that only a single contact element 5, 52 is present at the second part 12. A further contact element 5, 51 is situated at the base body 3. Both contact elements 5, 51, 52 lie opposite each other again in relation to a direction K of the contact normal force 7 and enclose the plug contact 2 in the inserted state, such that contacting of the plug contact 2 takes place from two sides.

In the embodiment shown in FIG. 3, the contact element 5, 51 located at the first part 11 can, however, have poorer electrical conductivity than the contact element 5, 52 arranged at the second part 12, because the base body 3 is composed of a material that is mechanically more stable but electrically poorly conductive.

A connecting section 15 is shown schematically in FIG. 3, with which the socket contact 1 can be connected electrically to a further element, for example, a cable.

Figure 4:
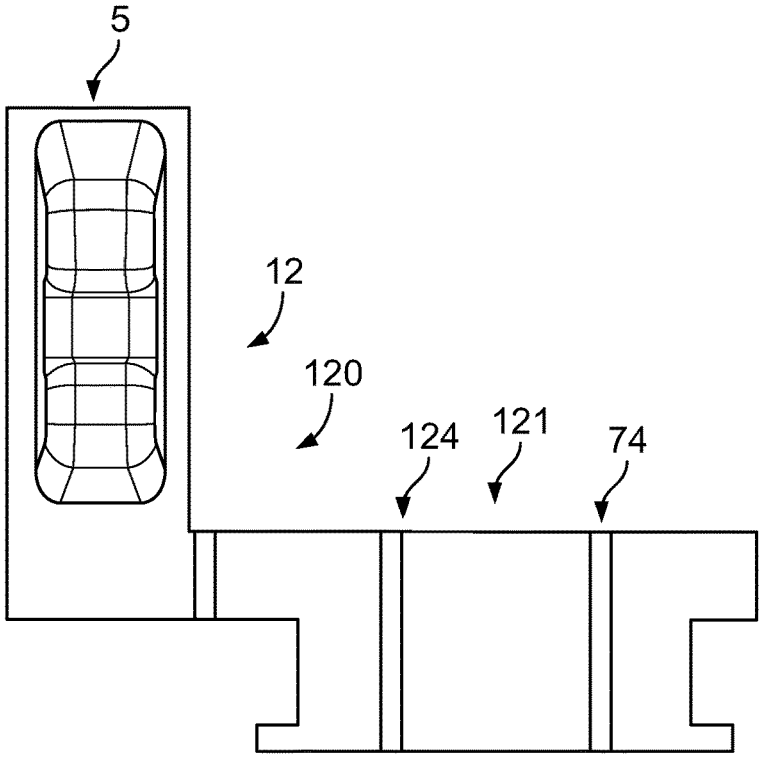
FIG. 4 is a plan view of a part of the socket contact of FIG. 3.

In FIG. 4 the second part 12 in the embodiment of FIG. 3 is shown as a separate element 120 in an unbent state. The contact element 5, 52 is attached to a base 124 which serves simultaneously as a retaining section 121.

Figure 5:
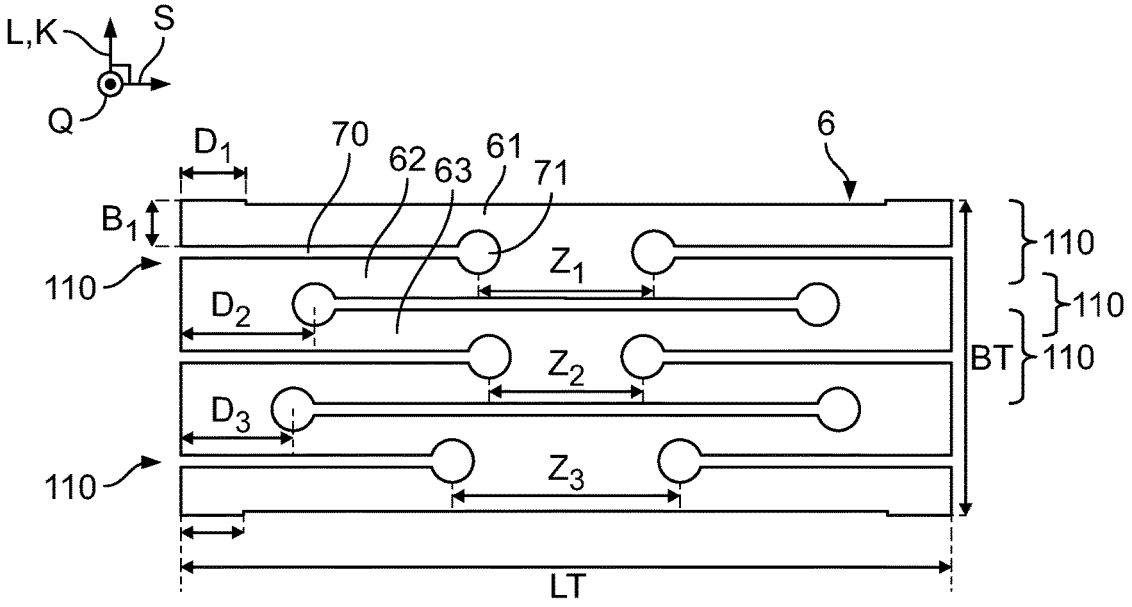
FIG. 5 is a schematic diagram of a spring device according to an embodiment.

A spring device 6 according to another embodiment is shown in FIG. 5. A plurality of limbs 61, 62, 63 again lie one behind the other along a longitudinal direction L and are separated from each other by gap 70. The gaps 70 each end in a circular hole 71. Depending on the desired spring force and spring characteristic, the spacings D2, D3, Z1, Z2, Z3, the width D1 of the connection, the total width BT and the length LT of the spring device 6 can be varied. The shown configuration of the spring device 6 is mirror symmetrical in the plug-in direction S, in order to achieve a uniform distribution of force. Here too, a plurality of spring sections 110 of the spring device 6 lie behind and next to one another, which spring sections 110 produce a desired contact normal force by an ideal arrangement and layout.

Figure 6:
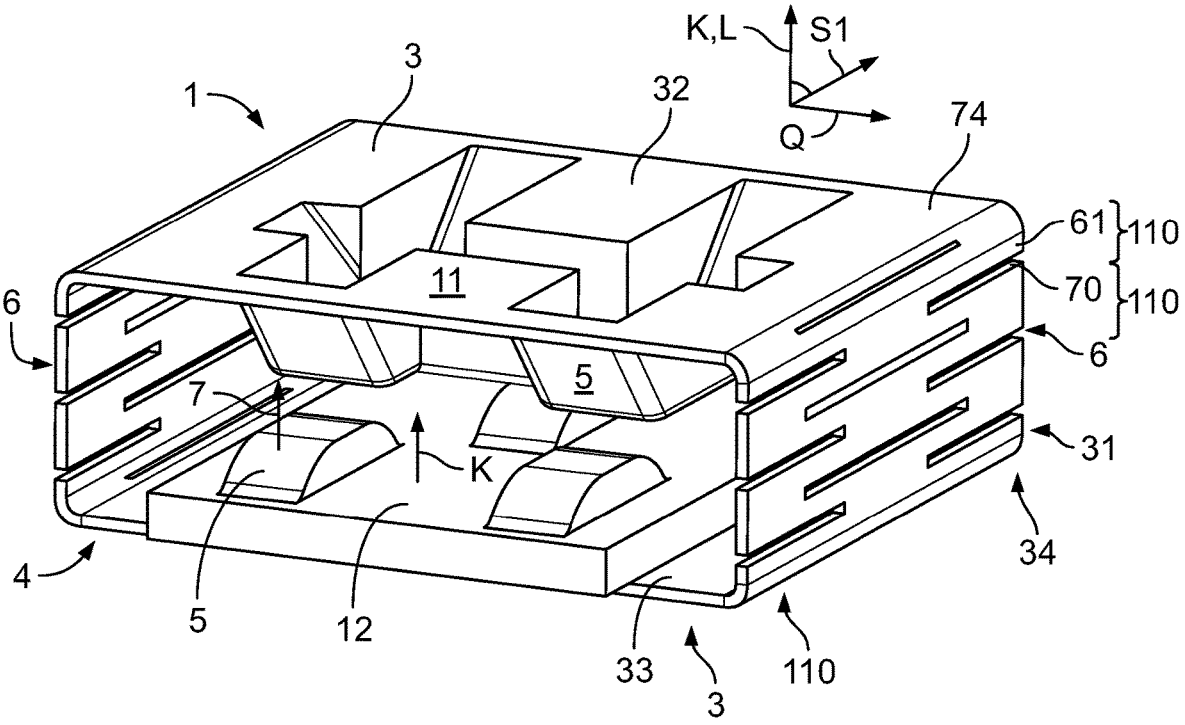
FIG. 6 is a perspective view of a socket contact according to another embodiment.
Figure 7:
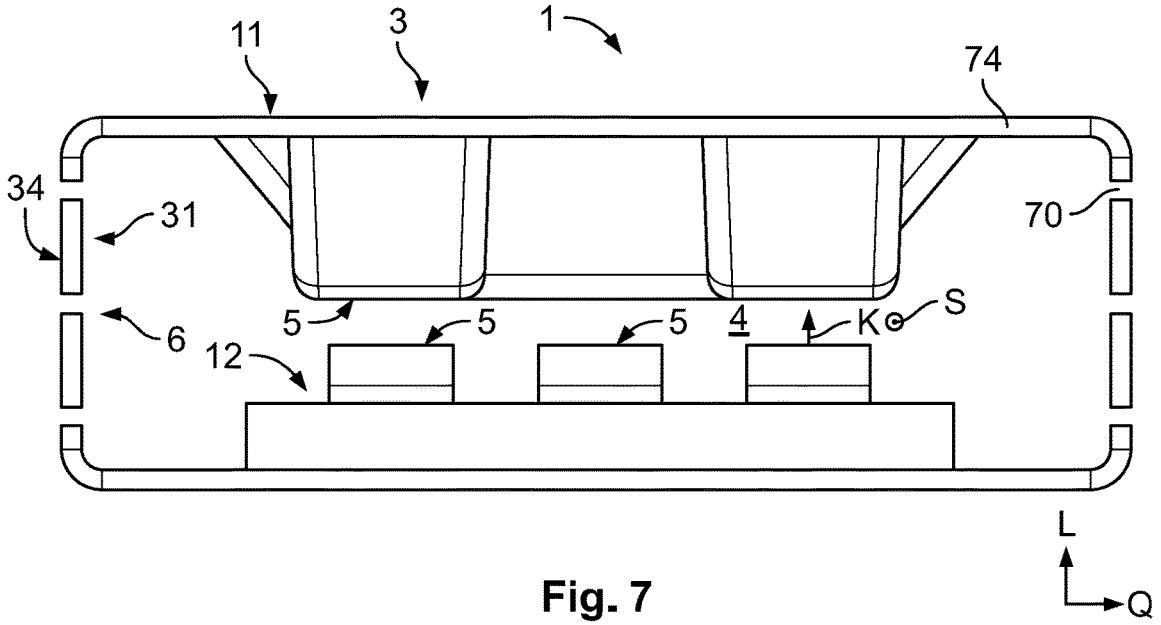
FIG. 7 is a front view of the socket contact of FIG. 6.

A socket contact 1 according to another embodiment is shown in FIGS. 6 and 7. The socket contact 1 has a relatively large extension in the transverse direction Q, such that a relatively wide plug contact 2 can be inserted, for example in order to transfer relatively high currents. Contact elements 5 are formed both at the base body 3 and also at a separate element 12, which is connected to the base body 3 or inserted in the latter. The contact elements 5 are again connected rigidly to the base body 3 and cannot be deflected elastically in relation to the base body 3, as was the case with previous spring arms.

Figure 8:
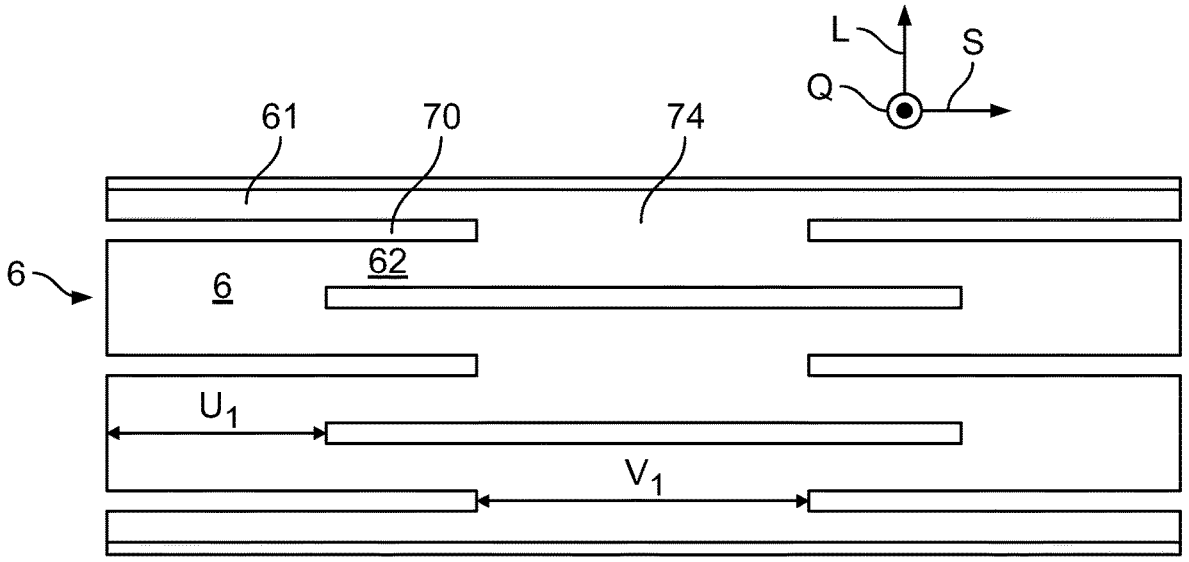
FIG. 8 is a schematic diagram of a spring device according to another embodiment.
Figure 9:
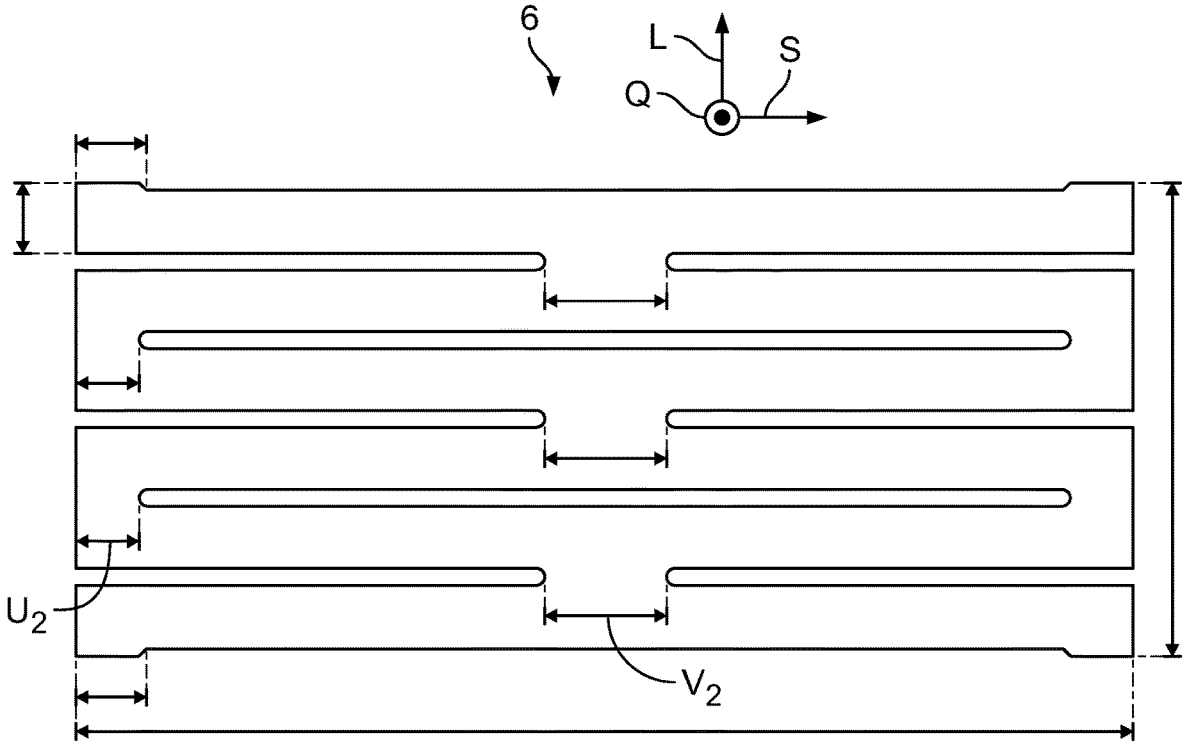
FIG. 9 is a schematic diagram of a spring device according to another embodiment.

FIGS. 8 and 9 depict further configurations of a spring device 6. Unlike the configurations in FIGS. 1, 3 and 5, the gaps 70 do not end in a circular hole 71. Such a configuration can be easier to produce and can be sufficient where there are only small deflections. The widths V1, V2 of the connecting sections between the limbs 61, 62, 63 and, respectively, the widths U1, U2 of the transition sections between the limbs 61, 62, 63 can be configured larger or smaller depending on the specific application.

What is claimed is:

1. A socket contact, comprising:

a receptacle receiving a plug contact;

a base body surrounding the receptacle at least in sections;

a contact element disposed in the receptacle and contacting the plug contact; and a spring device creating a contact normal force at the contact element, the spring device is formed as a part of the base body that surrounds the contact element, the spring device is arranged at a first part and the contact element is arranged at a second part separate from the first part, the spring device has a pair of interconnected limbs that lie one behind the other in a direction of the contact normal force.

2. The socket contact of claim 1, wherein the base body is made of a different material than the contact element.

3. The socket contact of claim 2, wherein the base body is made of a material having good mechanical properties.

4. The socket contact of claim 3, wherein the base body is made of a spring steel.

5. The socket contact of claim 3, wherein the contact element is made of a material having good electrical conducting properties.

6. The socket contact of claim 5, wherein the contact element is made of a copper material.

7. The socket contact of claim 1, wherein the spring device is part of a side wall of the base body.

8. The socket contact of claim 1, wherein the spring device is arranged at an outer side of the base body.

9. The socket contact of claim 1, wherein the spring device has a plurality of spring sections connected in parallel and/or in series.

10. The socket contact of claim 1, wherein the contact element is one of a pair of contact elements with a variable spacing.

11. The socket contact of claim 10, wherein the receptacle is between the pair of contact elements and the contact elements are interconnected by the spring device.

12. The socket contact of claim 1, wherein the contact element is rigidly connected to the base body.

13. The socket contact of claim 1, wherein the contact normal force is directed into the receptacle.

14. The socket contact of claim 1, wherein the spring device has a planar limb that lies in a plane parallel to the direction of the contact normal force.

15. The socket contact of claim 1, wherein the spring device connects an upper side and an underside of the base body and the contact normal force extends perpendicular to the upper side and to the underside.

16. The socket contact of claim 15, wherein the upper side and the underside are movable toward and away from each other along the direction of the contact normal force by deflection of the spring device.

17. A socket contact, comprising:

a receptacle receiving a plug contact;

a base body surrounding the receptacle at least in sections;

a contact element disposed in the receptacle and contacting the plug contact; and a spring device creating a contact normal force at the contact element, the spring device is formed as a part of the base body that surrounds the contact element, the spring device is arranged at a first part and the contact element is arranged at a second part separate from the first part, the spring device has a pair of interconnected limbs that lie against each other in a neutral state and are elastically deflected in relation to each other in a deflected state.

18. The socket contact of claim 17, wherein the pair of interconnected limbs are separate from each other by a gap in the deflected state.

19. The socket contact of claim 18, wherein the gap ends in a round hole.

* * * * *